United States Patent [19]

Prichard

[11] 4,266,491

[45] May 12, 1981

[54] TUFTING MACHINES AND KNIFE BLOCKS THEREFOR

[75] Inventor: Richard J. Prichard, Hixson, Tenn.

[73] Assignee: Spencer Wright Industries, Inc., Chattanooga, Tenn.

[21] Appl. No.: 121,805

[22] Filed: Feb. 15, 1980

[51] Int. Cl.[3] ..... D05C 15/00

[52] U.S. Cl. ..... 112/79 R

[58] Field of Search ..... 112/79 R, 79 FF, 79 A

[56] References Cited

U.S. PATENT DOCUMENTS

| | | | |
|---|---|---|---|
| 3,604,379 | 9/1971 | Cobble | 112/79 R |
| 3,662,697 | 5/1972 | Passons et al. | 112/79 R |
| 4,067,270 | 1/1978 | Short | 112/79 R |

FOREIGN PATENT DOCUMENTS

| | | | |
|---|---|---|---|
| 1369887 | 10/1974 | United Kingdom | 112/79 R |

*Primary Examiner*—Ronald Feldbaum

*Attorney, Agent, or Firm*—Alan Ruderman

[57] ABSTRACT

A tufting machine has alternate needles extending different lengths from the needle bar to respectively cooperate with hooks set at two different levels in the bed of the machine. Knives act with each hook to cut at least selective loops. The knives are mounted in knife blocks in pairs with each pair cooperating with a pair of adjacent hooks. Each knife block has a pair of knife receiving channels on opposite sides of a central web connecting a pair of elongated flanges. The flanges on one side of the web are stepped relatively to that on the other side by an amount substantially equal to the difference in levels between adjacent hooks and the channels are spaced closer together than the corresponding hooks so that both knives extend the same distance from the respective channel to engage the respective hook at the same location with substantially equal pressure.

4 Claims, 4 Drawing Figures

TUFTING MACHINES AND KNIFE BLOCKS THEREFOR

BACKGROUND OF THE INVENTION

This invention relates to tufting machines and more particularly to a knife block for supporting a pair of knives adapted to cooperate with and sever yarn loops on respective adjacent hooks positioned at different elevations relatively to the base fabric and thereby form cut pile of different pile heights in adjacent rows of stitching.

In co-pending United States patent application of Wilson Ser. No. 048,611, filed June 13, 1979, assigned to the assignee of the present invention, apparatus and method are disclosed for producing a tufted fabric having in alternate rows of stitching selective cut pile and loop pile and wherein the cut pile in alternate rows are of different pile height and all the loop pile is of a third and lower pile height. In the machine there disclosed a first set of needles penetrates the base fabric to cooperate with a first set of hooks at a first depth, and a second set of needles penetrates the backing fabric to cooperate with a second set of hooks at a second and lower depth. Each hook includes a spring clip and a respective cooperating knife and a yarn feed pattern attachment selectively feeds yarn to the first set of needles at a high and a low feed rate and to the second set of needles at an intermediate and the low feed rate. The low feed rate affects back-drawing of yarn past the spring clip to form loop pile while the two other feed rates allow the yarn to stay on the hooks to be severed by the respective knives.

With this system adjacent knives are mounted in a common knife block but coact with respective elevationally spaced hooks. Thus, the knives carried by a common knife block extend elevationally to different levels. It has now been determined that since the knives act at a small angle against a ledger edge of the respective hooks to provide a scissors-like cutting action, an unequal pressure or tension on adjacent hooks and an unequal resiliency of the knives exists when knife blocks of conventional construction are used in this environment. This in turn results in unequal wear on adjacent knives and inconsistent loop cutting action.

SUMMARY OF THE INVENTION

Consequently, it is a primary object of the present invention to provide a knife block for a tufting machine for mounting a pair of knives for cooperation with respective hooks spaced at different elevational levels while maintaining substantially equal knife pressure on both hooks with substantially equal resiliency of both knives.

It is another object of the present invention to provide in a tufting machine having adjacent needles which penetrate a base fabric to different extents and cooperate with respective hooks positioned at different levels, a knife block carrying a pair of knives which cooperate with adjacent hooks to sever loops of yarn thereon with substantially equal knife pressure on each hook.

Accordingly, the present invention provides a knife block for tufting machines having a pair of knife receiving channels between a pair of flanges on opposite sides of a substantially central web, and having the flanges on one side of the web stepped elevationally relatively to that on the other side, so that the knives may extend substantially the same distance longitudinally from the channels and cooperate with adjacent hooks positioned at different elevations in the tufting machine, the amount of the step being substantially equal to the elevational spacing between the cutting or ledger edges of adjacent hooks. The invention furthermore provides a knife block having a smaller gauge or lateral spacing between adjacent knife block channels, and thus the gauge of the knives, than the gauge of the respective cooperating hooks. In this manner substantially equal tension or pressure is exerted on the adjacent hooks since the resiliency or springing action of the knives are substantially equal.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
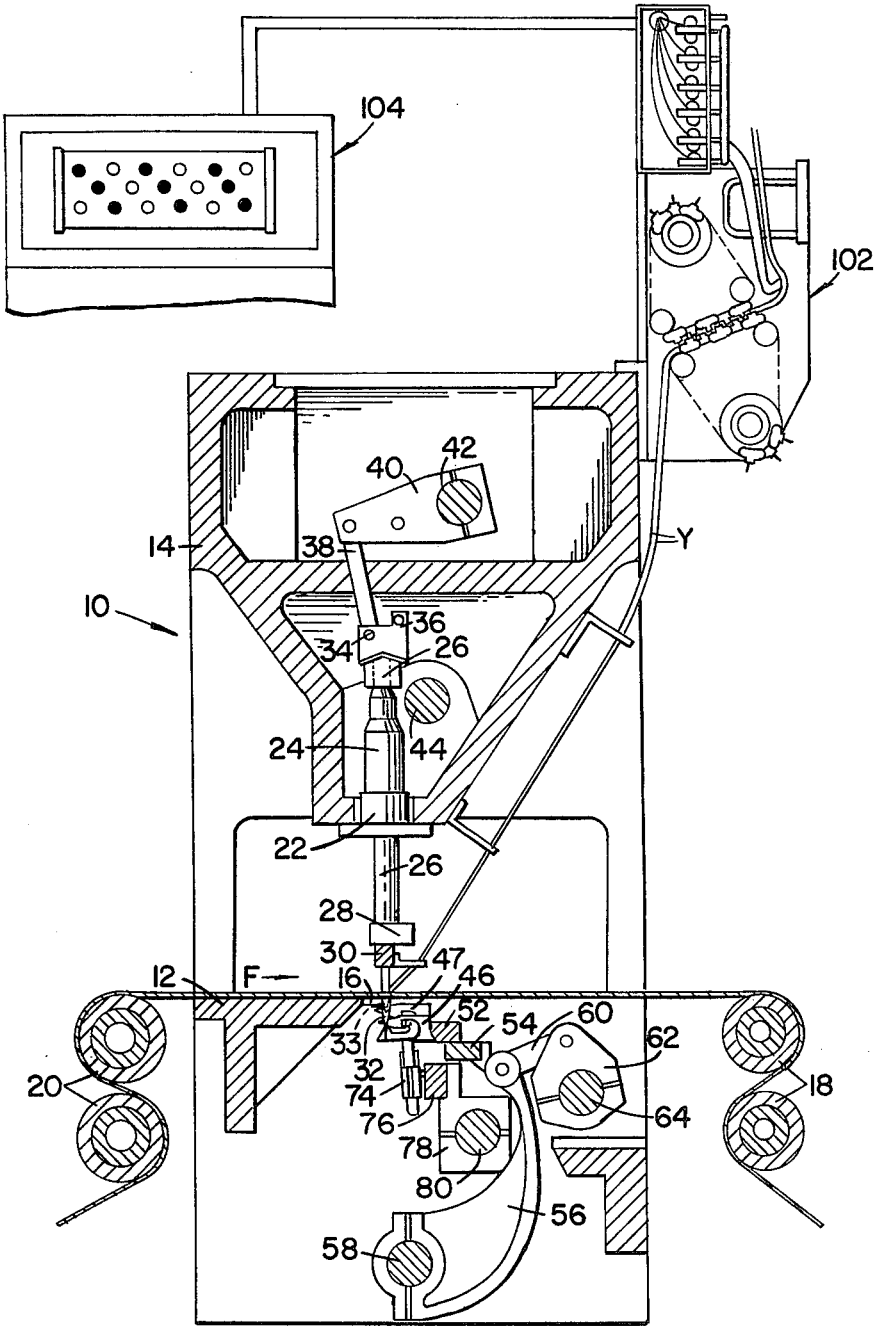
FIG. 1 is a vertical sectional view transversely through a tufting machine having stitching instrumentalities for producing a first level of cut pile in one row of stitching, another level of cut pile in an adjacent row of stitching, loop pile in each row, and incorporating knife blocks constructed in accordance with the present invention.

Referring to the drawings, there is illustrated in FIG. 1 a tufting machine 10 of the preferred form including a frame comprising a bed 12 and a head 14 disposed above the bed. The bed includes a bed plate 16 across which a base fabric F is adapted to be fed by a pair of feed rolls 18 and take off-rolls 20.

Mounted in the head are a plurality of collars 22 (only one of which is shown), for supporting a respective sleeve 24. Reciprocably mounted within each sleeve is a push rod 26, to the lower end of which a needle bar carrier 28 is attached and which carries a multiplicity of needles 32 and 33. The upper end of the push rod 26 is connected by a wrist pin 34 to a connecting member 36 which in turn is connected by a link 38 to a rock arm 40 on a rock shaft 42. Rocking motion is supplied to the shaft 42 by conventional means such as from a cam shaft 44 and is fully described in U.S. Pat. No. 2,977,905, to which reference may be made if a further description is desired. Briefly, a circular cam is eccentrically fixed to the shaft 44 and drives a lever fixed to shaft 42 through a connecting rod. Rotational motion of the shaft 44 is thus converted into rocking motion at shaft 42 to reciprocate the push rods 26, the needle bar 30 and the needles 32, 33.

Mounted in the bed 12 for cooperation with the needles to seize loops of yarn presented thereby are a plurality of loopers or hooks generally indicated at 46,47 and which have points facing in the direction opposite to that to which the fabric is fed. The hooks are conventionally mounted in slots 50 within hook bars 52 carried by a mounting bar 54 secured to the upper end of a rocker arm 56. Conventionally, the rocker arm 56 may be oscillated by a rock shaft 58 clamped at the lower end of the arm and journalled in the bed. Pivotably connected to the upper portion of the rocker arm is one end of the connecting link 60 having its other end pivotably connected between forked arms of a jack shaft rocker arm 62 which in turn is clamped to a jack shaft 64 oscillated by conventional drive means from the shaft 44 in timed relationship with the reciprocation of the needles.

Figure 2:
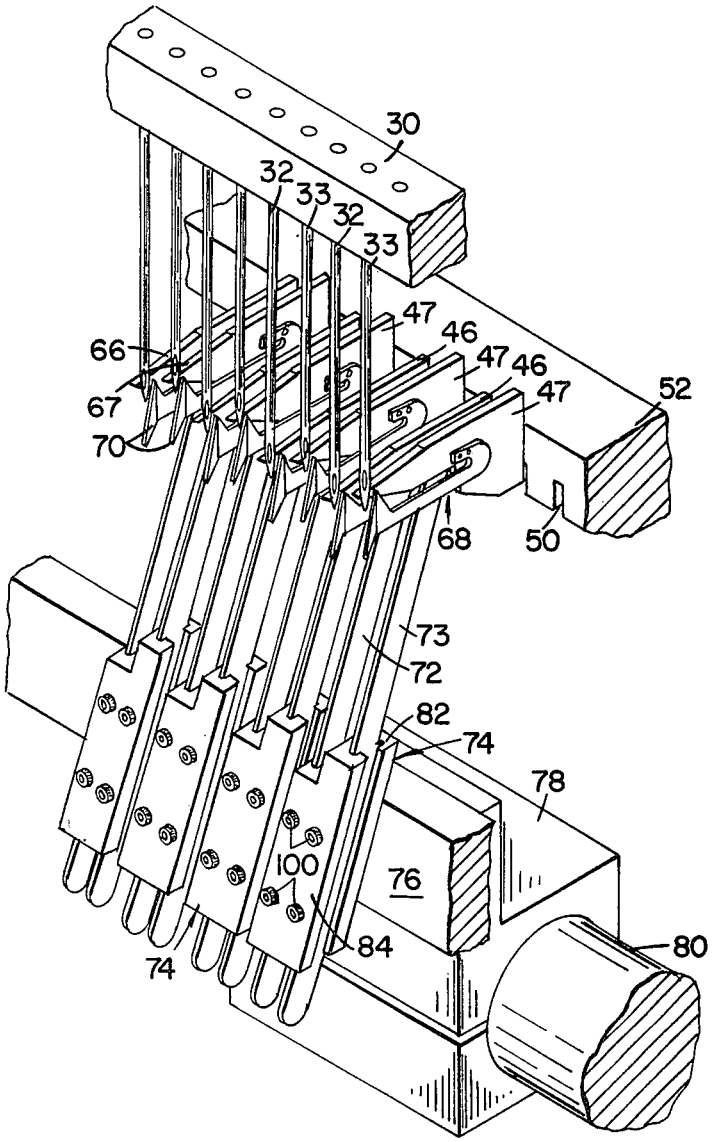
FIG. 2 is a perspective view greatly enlarged of the stitching and cutting instrumentalities of the tufting machine of FIG. 1, illustrating the construction of knife blocks.
Figure 4:
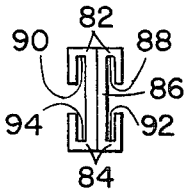
FIG. 4 is a top plan view of one of the knife blocks.

As best illustrated in FIG. 2 the needles 32 are set in the needle bar 30 lower than the needles 33 so that the needles 32 penetrate to a lower level than the adjacent needles 33. Thus, the hooks 46 which cooperate with the needles 32 have blade portions 66 at a lower level than the blade portions 67 of the hooks 47 which cooperate with the needles 33. One manner for providing this elevational difference between hooks is to cut the slots 50 for the hooks 46 deeper in the hook bar in the direction towards the head 14 than those slots which receive the hooks 47, and by providing identical hooks 46 and 47. All the hooks may thereby be of the same configuration, and as illustrated, may be of the cut/loop type forming the subject matter of U.S. Pat. No. 3,084,645 and include a resilient spring clip 68, but it should be understood that the present invention may be applied to a conventional cut type hook which does not utilize the spring clip. In the hooks disclosed, a loop is seized by the hook and stays thereon to be cut unless the loop is backdrawn with sufficient tension to force the head portion 70 of the clip to separate from the leading edge of the hook and allow the loop to be pulled off the hook. Those loops that are not backdrawn are cut by knives 72,73 which cooperate respectively with the hooks 46,47.

Each pair of knives is mounted in a knife block 74 secured to a knife bar 76 which in turn is secured to a knife shaft rocker arm 78 clamped to a knife shaft 80. Oscillatory movement is imparted to the knife shaft 80 to conventionally drive the knives angularly into engagement with one side of the respective hooks to provide a scissors-like cutting action, the one side being the side opposite from that to which the spring clip 68 is attached. Thus, cut pile is formed whenever a loop is cut by a knife, the pile level of the loops cut by the knife 72 acting on the hook 46 being longer than those formed by the knives 73 cutting on the hooks 47.

Figure 3:
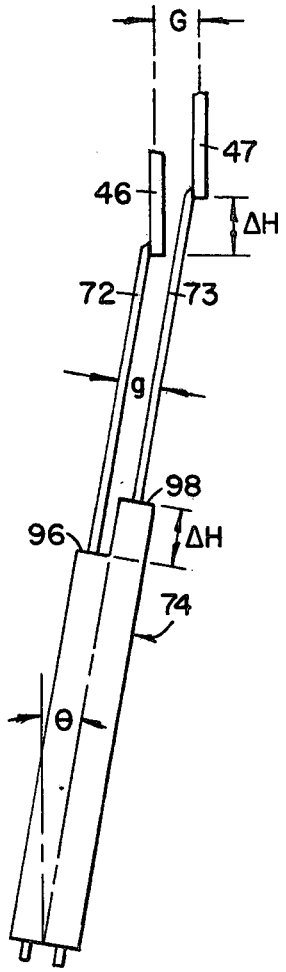
FIG. 3 is a diagrammatic view of one of the knife blocks and the relationship of the knives relatively to the hooks.

To overcome the aforesaid problems of unequal pressure of the knives against the hooks and the unequal resiliency of the knives, the knife blocks 74 of the present invention comprise an elongated body member provided with a pair of longitudinally extending flanges 82 and 84 having spaced marginal ends, the flanges being connected together by a substantially central web 86. The knives 72 and 73 are received within knife receiving channels formed by undercutting grooves 88,90 into the flange 82 and grooves 92,94 into the flange 84 adjacent each side of the web 86. In accordance with the invention the flanges 82 and 84 on the side of the web in which the grooves 90 and 94 are formed for receiving the knife 72 is stepped in the longitudinal direction elevationally below that of the flanges 82,84 on the side of the web in which the grooves 88 and 92 are formed for receiving the knives 73. As best illustrated in FIG. 3, the marginal end 96 of the flanges on the side of the web which carries the knife 72 is below the marginal end 98 at the other side of the web. Moreover, and of at least equal significance, the spacing between the knife receiving channels is reduced relatively to the spacing between adjacent hooks 46,47. Since the spacing between adjacent hooks is equal to the spacing between the adjacent cooperating needles, and is the gauge of the tufting machine and product formed thereby, the knife channels and thus the knives have a smaller gauge than the other machine gauge parts. Knife blocks are conventionally set in the machines with the knives at a slight cutting angle $\theta$ in the knife bar 76 to provide the required cutting action with the hooks. In order to ensure that the point of engagement of the knives with the hooks is at the correct location and with the same tension, the knife channels are ideally spaced apart by a distance (g) equal to the hook gauge (G), minus the elevational spacing between the adjacent hooks ($\Delta H$) multiplied by the sine of the angle $\theta$, i.e. $g = G - \Delta H \sin \theta$, the symbols being illustrated in FIG. 3. The angle $\theta$ in practice is in the order of approximately 10° and with a pile differential ($\Delta H$) of $\frac{3}{8}$ inch and a hook and machine gauge (G) of 3/16 inch, good results have been found when the knife gauge (g) is $\frac{1}{8}$ inch. Thus, knife 72 extends out the knife block to its point of engagement with the hook 46 the same distance as the knife 73 extends from the knife block to its corresponding point of engagement with the hook 47. Set screws 100 or the like may secure the knives thusly positioned in the channels. This results in both knives 72,73 of a knife block having the same resiliency and when set at the cutting angle in the knife bar 76, provides a substantially equal tension or pressure on the respective hook as it rides along the side of the hook into cutting engagement with a loop.

The yarn requirements of each needle and hook combination may be obtained by feeding a greater amount of yarn to each needle 32 hook 46 combination than to the needle 33 hook 47 combination to obtain the two levels of cut. With a cut/loop hook system as disclosed herein, and as more fully disclosed in the aforesaid copending patent application of Wilson, the yarn fed to the needles 32 are at a high rate for forming the cut pile and a low rate for forming the loop pile, while the yarn fed to the needles 33 are at a rate intermediate the high and low rate to form the shorter cut pile and at the low rate again to form the loop pile. In this regard a yarn feed mechanism generally indicated at 102 may be incorporated with the tufting machine and controlled by a pattern control system 104, the full description of which is unnecessary for purposes of the present disclosure and a fuller understanding thereof may be obtained from the disclosure of the aforesaid copending patent application.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. In a tufting machine having a frame including a laterally extending bed and a head positioned above the bed, a first needle reciprocable into cooperation with a first hook positioned in the bed to form loops thereon, a second needle reciprocable into cooperation with a second hook positioned in the bed spaced laterally adjacent to and elevationally above the first hook to form loops of yarn thereon, and an oscillatory knife block for carrying a first knife adapted to cooperatively engage said first hook to sever loops thereon and a second knife adapted to cooperatively engage said second hook to sever loops thereon, said knife block comprising an elongated body member having a pair if longitudinally extending spaced flanges connected together by a substantially centrally disposed web, a first channel defined on one side of said web for receiving said first knife, a second channel defined on the other side of said web for receiving said second knife, said channels being laterally spaced an amount less than the lateral spacing between said first and second hooks, the flanges on said one side of said web being stepped elevationally relatively to the flanges on the other side of said web by a distance substantially equal to the elevational spacing between said first and second hooks, and means for securing said knives in said channels with substantially equal lengths of said knives extending therefrom in a direction toward said hooks.

2. In a tufting machine as recited in claim 1 wherein said knives are positioned at an angle to said hooks, and said channels are spaced apart laterally by an amount substantially equal to the spacing between said hooks minus the elevational spacing of said hook multiplied by the sine of said angle.

3. A knife block for a tufting machine comprising an elongated body member having a pair of longitudinally extending spaced flange portions connected together by a substantially centrally disposed web, a knife receiving channel defined on each side of said web, one marginal end of the flanges on one side of said web being stepped relatively to the corresponding marginal end of the flanges on the other side of said web, whereby equal knife lengths extending from the said marginal ends have terminal portions longitudinally spaced by an amount substantially equal to the step between said marginal ends of said flanges.

4. A knife block as recited in claim 3 wherein each channel includes a pair of longitudinally extending facing grooves in the flanges adjacent said web, the grooves on said one side being longitudinally shorter than the grooves on the other side of said web.

* * * * *